US010257600B2

(12) United States Patent
Hsieh et al.

(10) Patent No.: US 10,257,600 B2
(45) Date of Patent: Apr. 9, 2019

(54) EARPHONE

(71) Applicant: 1MORE Inc., Shenzhen (CN)

(72) Inventors: Kuan-Hong Hsieh, Shenzhen (CN); Yonghui Hu, Shenzhen (CN); Qianlong Liu, Shenzhen (CN)

(73) Assignee: 1MORE INC., Shenzhen, Guangdong Province (CN)

( * ) Notice: Subject to any disclaimer, the term of this patent is extended or adjusted under 35 U.S.C. 154(b) by 7 days.

(21) Appl. No.: 15/123,987

(22) PCT Filed: May 11, 2016

(86) PCT No.: PCT/CN2016/081644

§ 371 (c)(1),
(2) Date: Sep. 6, 2016

(87) PCT Pub. No.: WO2017/049910

PCT Pub. Date: Mar. 30, 2017

(65) Prior Publication Data

US 2017/0264986 A1 Sep. 14, 2017

(30) Foreign Application Priority Data

Sep. 21, 2015 (CN) ..... 2015 2 0733973 U

(51) Int. Cl.
*H04R 1/10* (2006.01)
*H04R 1/28* (2006.01)

(52) U.S. Cl.
CPC ..... *H04R 1/1016* (2013.01); *H04R 1/10* (2013.01); *H04R 1/1033* (2013.01); *H04R 1/1075* (2013.01); *H04R 1/2857* (2013.01)

(58) Field of Classification Search
CPC .. H04R 1/1016; H04R 1/1033; H04R 1/1075; H04R 1/2857
USPC ..... 381/380
See application file for complete search history.

(56) References Cited

U.S. PATENT DOCUMENTS

2005/0247515 A1 11/2005 Berg
2009/0214072 A1* 8/2009 Staab ..... H04R 25/656 381/380
2011/0235843 A1* 9/2011 Keady ..... A61F 11/10 381/380
2012/0128192 A1* 5/2012 Burgett ..... H04R 1/1016 381/380
2012/0134520 A1* 5/2012 Zhao ..... H04R 25/656 381/313

(Continued)

FOREIGN PATENT DOCUMENTS

CN 101662710 A * 3/2010
CN 103069839 A 4/2013
CN 204968071 U 1/2016

OTHER PUBLICATIONS

International Search Report (English Translation) for PCT/CN2016/081644 dated Jul. 28, 2016.

*Primary Examiner* — Sean H Nguyen
(74) *Attorney, Agent, or Firm* — Cheng-Ju Chiang

(57) ABSTRACT

An earphone includes a housing having a sound output hole, wherein a center axis line of the sound output hole is deviated from a center axis line of the housing by an angle; a drive unit received inside the housing; and a resilient element disposed on the housing, wherein the resilient element can be squeezed and deformed, the resilient element or the housing abuts a cavum conchae of a user.

20 Claims, 12 Drawing Sheets

(56) References Cited

U.S. PATENT DOCUMENTS

| | | | | |
|---|---|---|---|---|
| 2014/0146989 | A1* | 5/2014 | Goldstein | A61F 11/08 381/380 |
| 2014/0270315 | A1* | 9/2014 | Burgett | H04R 1/105 381/380 |
| 2015/0110320 | A1* | 4/2015 | Liu | H04R 1/1016 381/322 |
| 2015/0146909 | A1* | 5/2015 | Kirkpatrick | H04R 25/652 381/380 |

* cited by examiner

EARPHONE

RELATED APPLICATIONS

This application is a United States National Stage Application filed under 35 U.S.C 371 of PCT Patent Application Serial No. PCT/CN2016/081644, filed May 11, 2016, which claims Chinese Patent Application Serial No. CN 201520733973.6, filed Sep. 21, 2015, the disclosure of all of which are hereby incorporated by reference in their entirety.

FIELD OF THE INVENTION

The present disclosure relates to a field of audio device, and more particularly relates to an earphone.

BACKGROUND OF THE INVENTION

With the progress of science and technology, the popularity of mobile audio equipment has been increased. As a mobile audio output device, earphones play an important role in people's life.

However, when most of earphones are worn by a user, the housing protrudes from a cavum conchae of the user and is exposed to the outside, such that the earphone tends to slip out from the user's ear. To address the problem of slipping, earphones with smaller size which can be placed in the ear of the user are employed. However, the design size of the conventional earphone usually does not completely fit the size of cavum conchae. If the size of earphone is too big, the concha will be abutted and the user's ear is compressed; if the size of earphone is too small, the earphone is easily to be slipped out from the user's ear. Therefore, it is inconvenient.

SUMMARY OF THE INVENTION

Accordingly, it is necessary to provide an earphone that is convenient to wear.

An earphone includes: a housing having a sound output hole, wherein a center axis line of the sound output hole is deviated from a center axis line of the housing by an angle; a drive unit received inside the housing; and a resilient element disposed on the housing, wherein the resilient element can be squeezed and deformed, the resilient element or the housing abuts a cavum conchae of a user.

An earphone includes: a housing; a drive unit received inside the housing; and an earpiece fixed to an end of the housing, wherein the earpiece is made of flexible material and can be deformed when squeezed by ear canal, the earpiece has a sound output hole and defines a sound output channel therein which is in communication with the sound output hole, and the sound output channel extends along a center axis line which is deviated from a center axis line of the housing by an angle.

An earphone includes: a housing; a drive unit received inside the housing; an earpiece fixed at an end of the housing, wherein the earpiece has a sound output hole and defines a sound output channel therein which is in communication with the sound output hole, the sound output channel extends along a center axis line which is deviated from a center axis line of the housing by an angle; and a cord, wherein the housing defines a first through hole on a middle portion of a side of the housing, the cord extends through the first through hole and is connected to the drive unit, the housing and the earpiece are received inside a cavum conchae of a user, and the cord extends between a tragus and a antitragus of the user.

The aforementioned earphone includes a resilient element provided on the housing. When wearing the earphone, the resilient element can be squeezed and deformed with respect to the housing, such that the size of the earphone can fit cavum conchaes with different sizes. The earphone will reduce the pressure felt by the user's ear, and it can be fit in the cavum conchae to ensure that the earphone will not be easy to slip out from the user's ear.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

Figure 1:
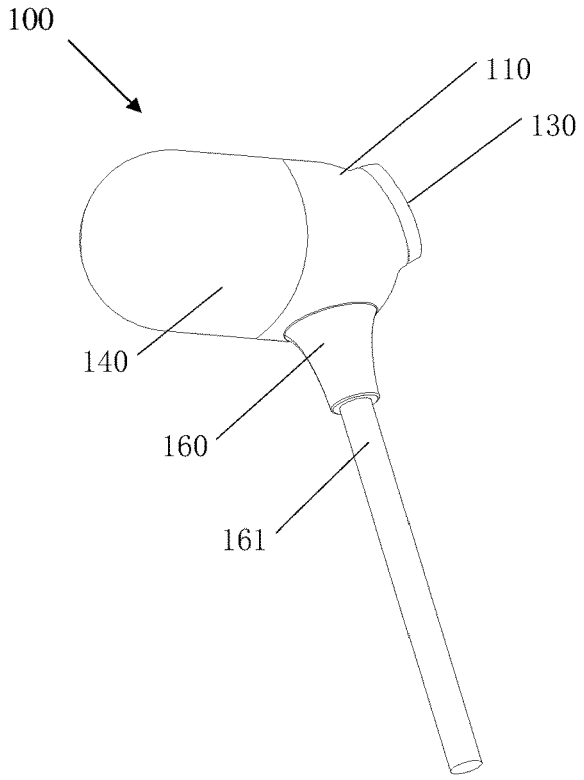
FIG. 1 is a perspective view of an earphone in accordance with a first embodiment.

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

Figure 2:
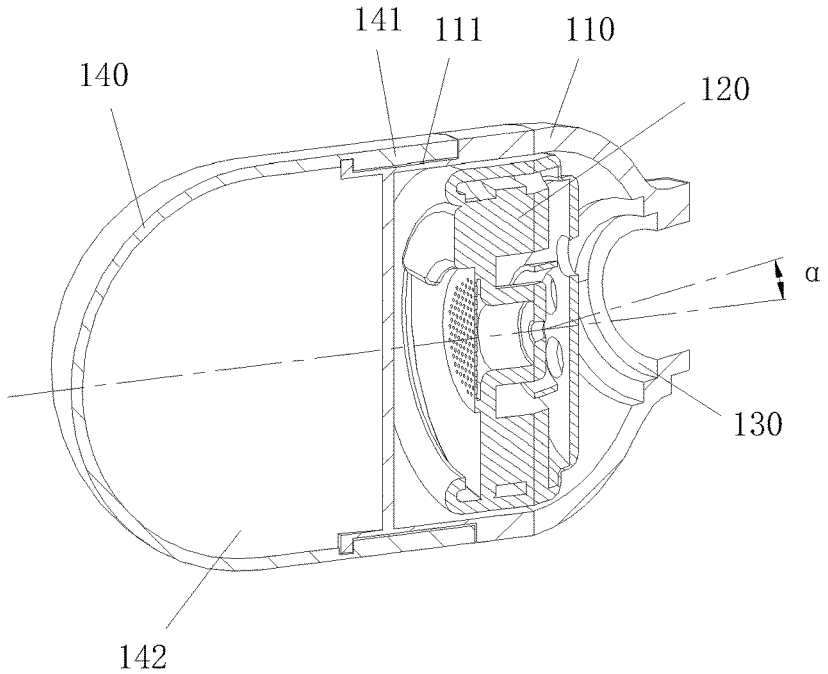
FIG. 2 is a cross-section view of the earphone of FIG. 1.

Referring to FIG. 1 and FIG. 2, in a first embodiment, an earphone 100 includes a housing 110, a drive unit 120, a resilient element 140, and a cord retainer 160.

The housing 110 is shaped substantially as a hollow circular tube with one end constricted. The drive unit 120 is located inside the housing 110. A sound output hole 130 is defined at one end of the housing 110. The sound output hole 130 is configured to be deviated from the housing 110 by an angle, i.e. an angle $\alpha$ is formed by a center axis line of the sound output hole 130 and a center axis line of the housing 110. The angle $\alpha$ may satisfy: $30° \leq \alpha \leq 60°$. Thus, the sound output hole 130 can directly face an ear canal of the user when the earphone 100 is placed in the cavum conchae of the user, such that a high quality sound experience can be provided for the user. In the illustrated embodiment, the angle $\alpha$ is 45°.

The resilient element 140 is shaped as a part of a capsule, and it is positioned at an end of the housing 110 away from the sound output hole 130. The resilient element 140 can be deformed, such as expanding or contracting, when subjected to external force. In the illustrated embodiment, the resilient element 140 is made of silica gel. In other embodiments, the resilient element 140 can be made of collapsible plastic, or other flexible, elastically stretchable materials.

The resilient element 140 can be sleeved, latched, bonded, or integrally formed with the housing 110. In the illustrated embodiment, in order to make sure the resilient element 140 is well connected to the housing 110, a groove 111 is provided on an outer surface of the housing 110 latching the resilient element 140, and a protrusion 141 is provided on an inner surface of the resilient element 140, the protrusion 141 is latched in the groove 111. Vice versa, it should be understood that the groove can be provided on the resilient element 140, and the protrusion can be provided on the resilient element 140. In the illustrated embodiment, a gap 142 is formed between the resilient element 140 and the housing 110. The gap 142 can be filled with air or other flexible materials to improve wearing comfort, such as sponge, solid glue, and the like.

The cord retainer 160 is provided on the housing 110 and positioned away from the sound output hole 130. The drive unit 120 received inside the housing 110 can be led out of the housing 110 via an earphone cord 161. The cord retainer 160 can protect the earphone cord 161 from being cut by pulling off. The cord retainer 160 is made of silicon material with a better tensile strength.

The angle formed between a center axis line of the cord retainer 160 and the center axis line of the sound output hole 130 is in a range from 100° to 130°. The cord retainer 160 and the sound output hole 130 are provided on the same end of the housing 110, and an angle is formed by the cord retainer 160 and the sound output hole 130. If the angle matches the angle formed between the ear canal and the intertragic notch, it will achieve the optimal state. That is, when the sound output hole is embedded in the ear canal, the cord retainer 160 and the earphone cord 161 can extend and fit smoothly between the tragus and the antitragus.

Figure 3:
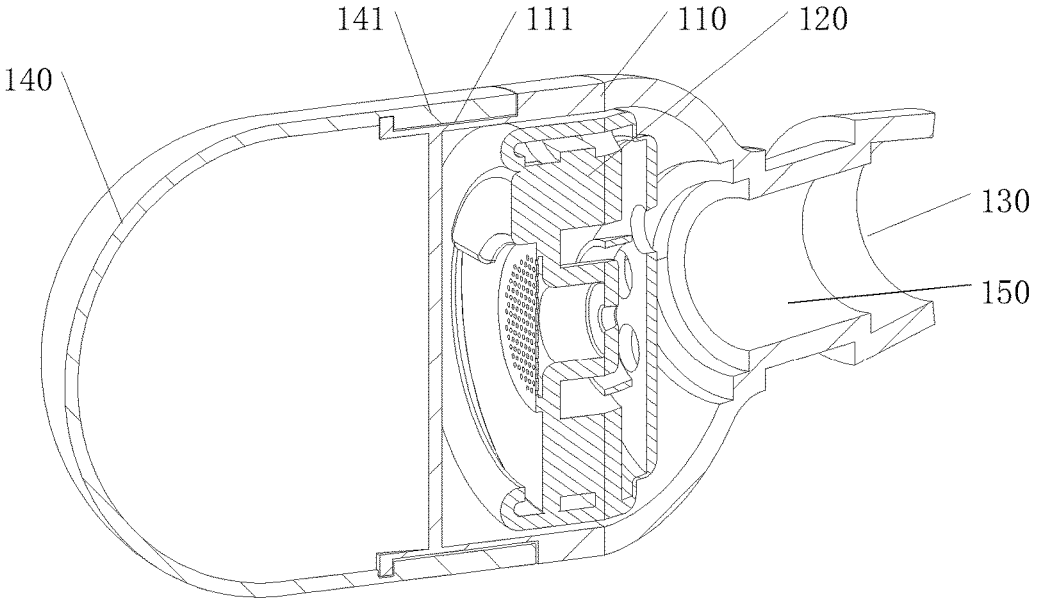
FIG. 3 is a cross-section view of an earphone in accordance with a second embodiment.

Referring to FIG. 3, an earphone according to the second embodiment has a structure similar to the earphone 100 according to the first embodiment. The difference is that, the housing 110 is provided with a sound guide tube 150 protruding from one end of the housing 100. The sound output hole 130 is provided at one end of the sound guide tube 150 away from the housing 110. The sound guide tube 150 can be provided with an additional earpiece 170 (referring to FIG. 4). The configuration of the sound guide tube 150 can allow the earpiece to be easily inserted into the ear canal, so as to ensure tightness.

Figure 4:
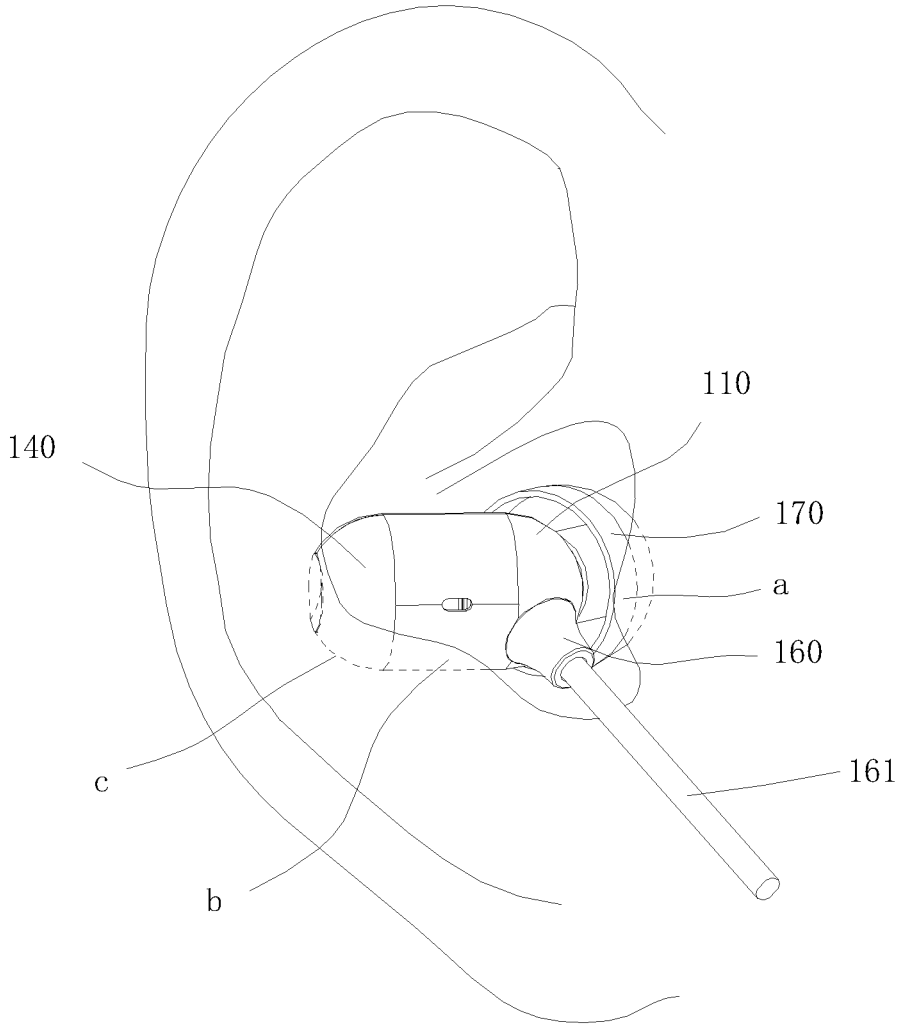
FIG. 4 is a perspective view of the earphone of FIG. 3 in a fitting state.

Referring to FIG. 4, when a user is wearing the earphone 100, the center axis line of the sound output hole 130 is deviated from the center axis line of the housing 110 by an angle, such that the sound output hole 130 can be oriented towards the user's ear canal, thus providing a high sound quality experience for the user. In addition, when the user is wearing the earphone 100, the entire housing 110 and the elastic 140 can be accommodated inside the user's cavum conchae. By providing the resilient element 140 on the housing 110 which can be squeezed and deformed with respect to the housing 110, the earphone will reduce the pressure felt by the user's ear, and it can be fit in the cavum conchae to ensure that the earphone will not be easy to slip out from the user's ear, such that the earphone 100 can fit cavum conchae with different sizes. Furthermore, by configuring the angle formed between a center axis line of the cord retainer 160 and the center axis line of the sound output hole 130, the cord retainer 160 and the earphone cord 161 can extend between tragus a and antitragus b of the user, such that the outer surface of the earphone can completely fit human's ear structure without causing any discomfort during wearing. When the earphone cord 161 is pulled downwardly, the tragus and the antitragus can hold the earphone 100 and prevent it from falling out of the cavum conchae, thus further increasing wearing stability and using convenience.

Figure 5:
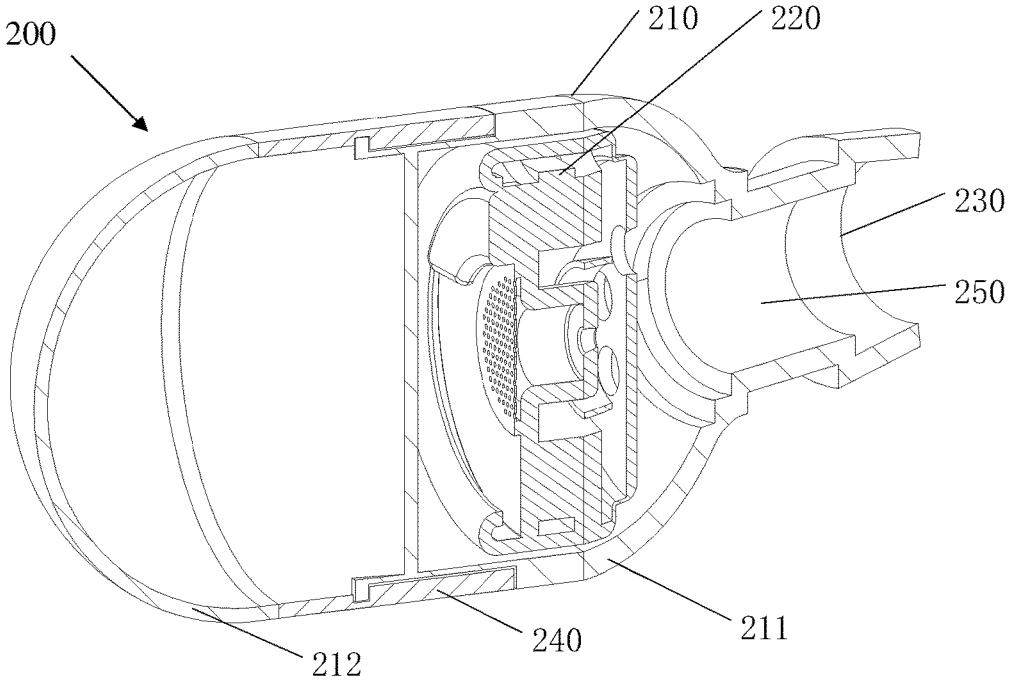
FIG. 5 is a cross-section view of an earphone in accordance with a third embodiment.

Referring to FIG. 5, an earphone 200 according to the third embodiment has a structure similar to the earphone 100 according to the first embodiment. The difference is that, the housing 210 includes a first housing 211 and a second housing 212 connected to the first housing 211. A drive unit 220 is received inside the first housing 211. A sound guide tube 250 is provided at an end of the first housing 211 away from the second housing 212. A resilient element 240 is located between the first housing 211 and the second housing 212.

In the illustrated embodiment, the resilient element 240 is located at an end of the second housing 212 close to the first housing 211. When a user is wearing the earphone 200, the first housing 211 or the second housing 212 is squeezed, the resilient element 240 is deformed, which result in a relative displacement between the first housing 211 and the second housing 212, and the end of the second housing 212 can abut the user's cavum conchae.

In the illustrated embodiment, a groove is provided on an outer surface of the second housing 212 which is sleeved on the resilient element 240, and a protrusion is provided on an inner surface of the resilient element 240, the protrusion is latched in the groove, thus ensuring a better fixing between the resilient element 240 and the second housing 212. Meanwhile, the resilient element 240 and the first housing 211 can be fixed also by engaging of the protrusion and groove.

It should be understood that, in other embodiments, the resilient element 240 can be located at an end of the second housing 212 away from the first housing. In other words, structures and positions of the resilient element 240 and the second housing 212 can be exchanged.

Figure 6:
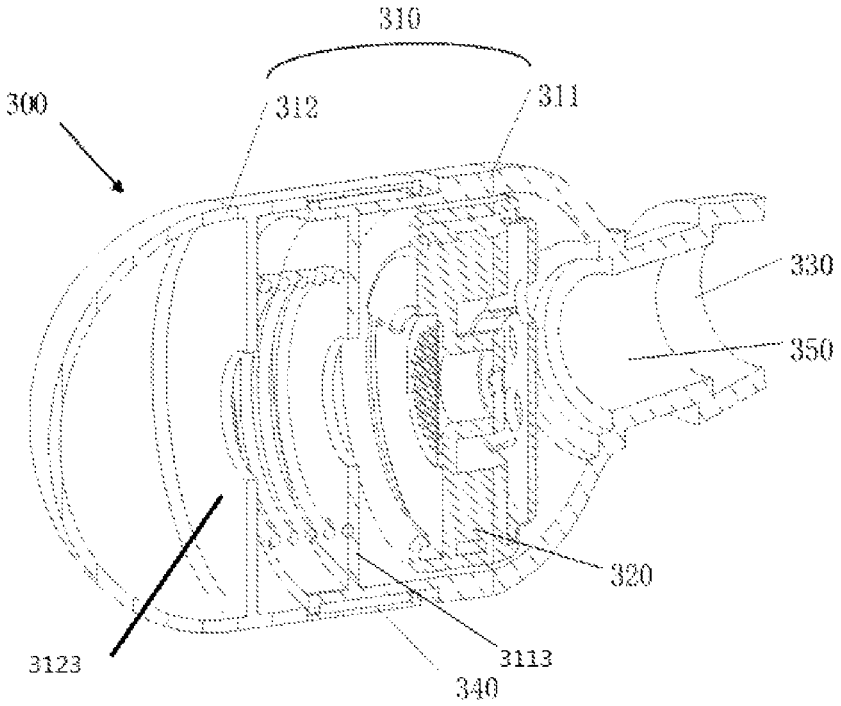
FIG. 6 is a cross-section view of an earphone in accordance with a forth embodiment.
Figure 7:
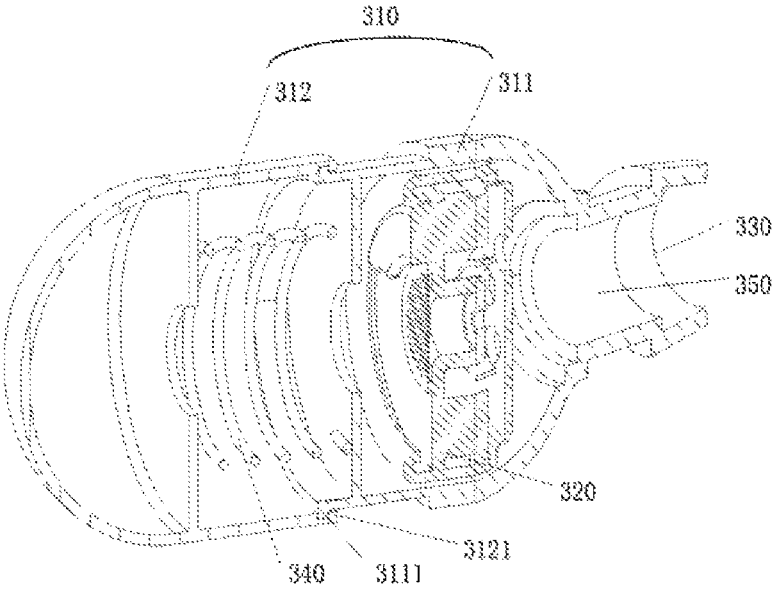
FIG. 7 is a cross-section view of the earphone of FIG. 6 shown in another state.

Referring to FIG. 6 and FIG. 7, an earphone 300 according to the fourth embodiment has a structure similar to the earphone 100 according to the first embodiment. The difference is that, the housing 310 includes a first housing 311 and a second housing 312 connected to first housing 311. A drive unit 320 is located inside the first housing 311. A sound guide tube 350 is provided at one end of the first housing 311 away from the second housing 312. A resilient element 340 is located between the first housing 311 and the second housing 312.

In the illustrated embodiment, a first partition plate 3113 is provided inside the first housing 311, and a second partition plate 3123 is provided inside the second housing 312. The resilient element 340 is a spring. One end of the resilient element 340 is fixed to the first partition plate 3113, and the other end of the resilient element 340 is fixed to the second partition plate 3123. Referring to FIG. 6, when the first housing 311 and the second housing 312 are squeezed, the spring will be compressed. Referring to FIG. 7, the spring stretches into a natural state when it is not squeezed.

In the illustrated embodiment, in order to prevent disengagement of the first housing 311 and the second housing 312 when the spring stretches into a natural state, a limiting lug 3111 is provided on the first housing 311, and a corresponding lug 3121 matching the first bump 3111 is provided on the second housing 312.

Figure 8:
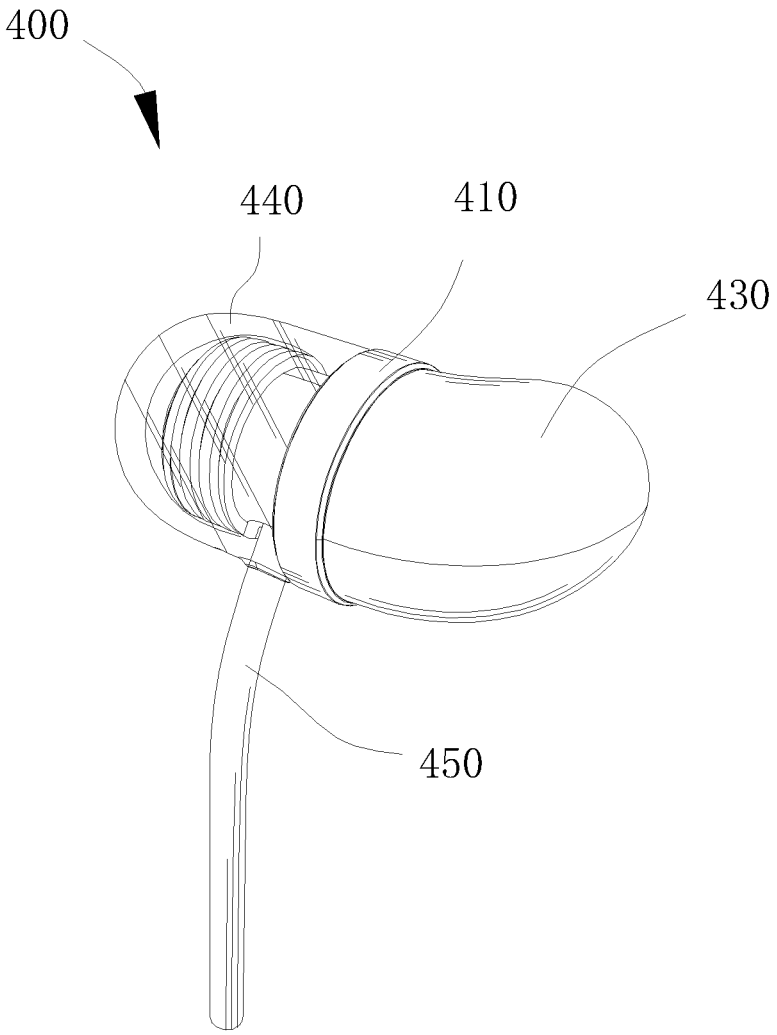
FIG. 8 is a perspective view of an earphone in accordance with a fifth embodiment.
Figure 9:
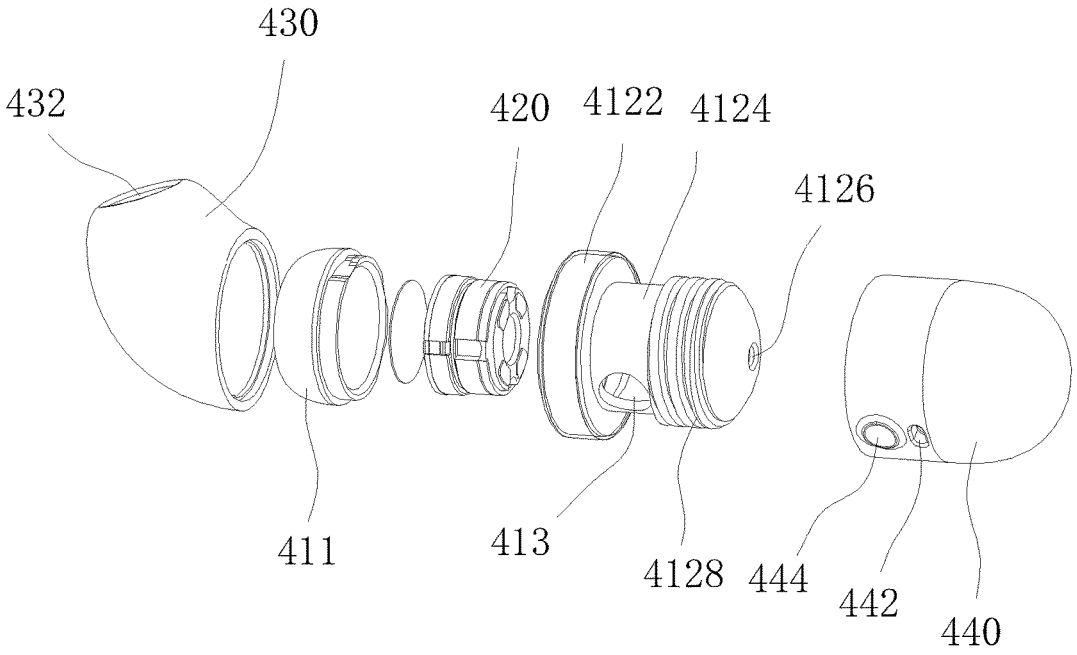
FIG. 9 is an exploded, perspective view of the earphone of FIG. 8.

Referring to FIG. 8 and FIG. 9, an earphone 400 according to a fifth embodiment includes a housing 410, a drive unit 420, an earpiece 430, a resilient element 440, and an earphone cord 450.

Figure 11:
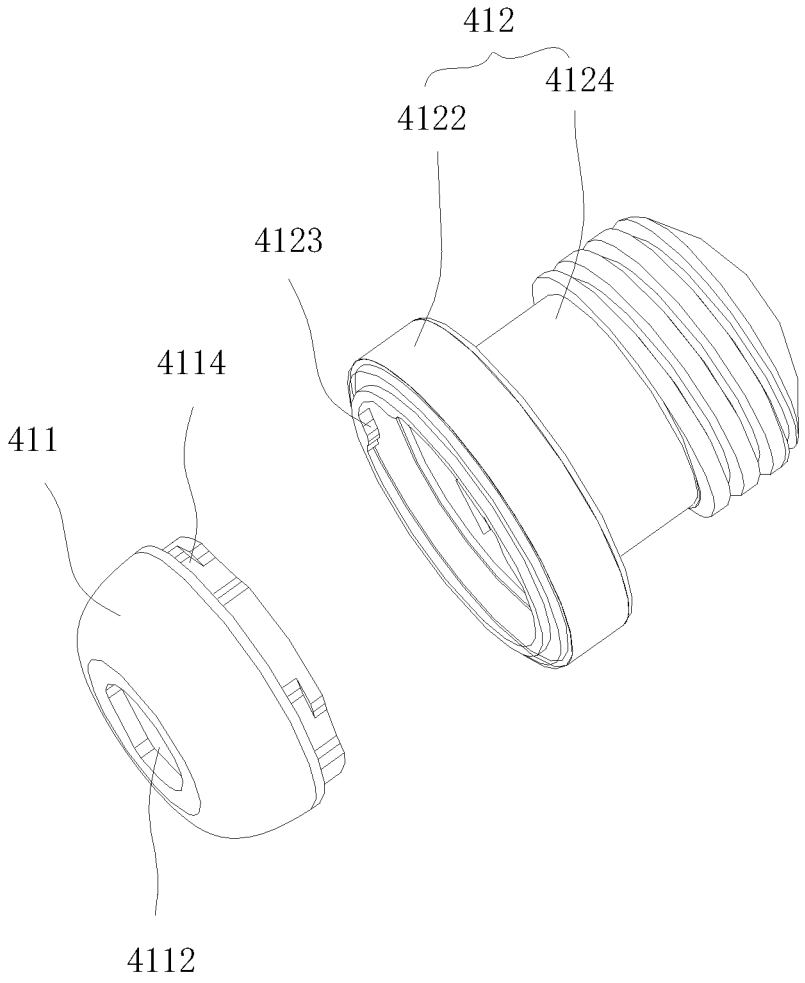
FIG. 11 is an enlarged, perspective view of the first housing and the second housing of FIG. 9 viewed from another aspect.

The housing 410 includes a first housing 411 and a second housing 412 connected to the first housing 411. The first housing 411 is shaped substantially as a circular cover, and a sound emission hole 4112 (referring to FIG. 11) is defined on a front end of the first housing 411. The drive unit 420 is received in first housing 411 and is oriented towards the sound emission hole 4112. It should be understood that, in other embodiments, the drive unit 420 can be also located inside the second housing 412, or positioned between the first housing 411 and the second housing 412. The second housing 412 includes a latching portion 4122 and a sound amplification portion 4124 connected to the latching portion 4122. The latching portion 4122 has a substantially annular shape, and the sound amplification portion 4124 has a substantially conical shape. The diameter of the latching portion 4122 is less than the diameter of the sound amplification portion 4124. In the illustrated embodiment, a limiting slot 4114 is provided in an edge of a rear end of the first housing 411, and a limiting lug 4123 is provided in the latching portion 4122. The first housing 411 and the second housing 412 are fixed together by engaging the limiting lug 4123 in limiting slot 4114. It should be understood that, the first housing 411 and the second housing 412 can be fixed by other means, such as gluing, ultrasonic welding, and threaded connection, and the like.

Figure 10:
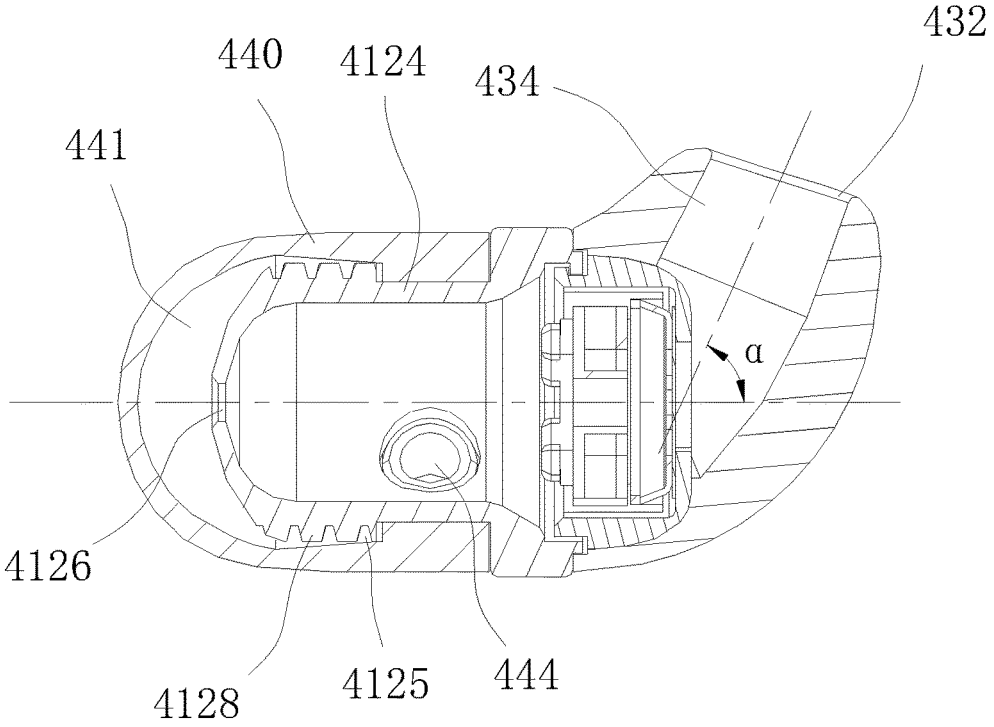
FIG. 10 is a cross-section view of the earphone of FIG. 8.

The earpiece 430 is fixed at an end of the housing 410. In the illustrated embodiment, the earpiece 430 is sleeved on the first housing 411 via gluing or ultrasonic welding. The earpiece 430 has a shape similar to a curved pipe. Referring also to FIG. 10, the earpiece 430 defines a sound output hole 432, and the earpiece 430 forms a hollow sound output channel 434 therein, which is in communication with the sound output hole 432. The sound emission hole 4112 on the first housing 411 is in communication with the sound output channel 434, such that sound generated from the drive unit 420 can enter the sound output channel 434 via the sound emission hole 4112 and then enter a user's ear canal from the sound output channel 434 via the sound output hole 432. The sound output channel 434 extends along a direction which is deviated from a center axis line of the housing 410 by an angle $\alpha$. The extension direction of the sound output channel 434 is defined as an extension direction of connecting line composed by each center point of each section of the sound output channel 434. The angle $\alpha$ satisfies: $50° \leq \alpha \leq 80°$.

In the illustrated embodiment, the angle $\alpha$ is 65°. Therefore, when the earphone 400 is placed inside the user's cavum conchae, the sound output hole 432 of the earpiece 430 can extend into a user's ear canal, so as to provide a high quality sound experience for the user. In other embodiments, the earpiece 430 can be positioned at the entrance of the ear canal by changing the shape of the earpiece 430. The earpiece 430 is made of flexible materials, such as silica gel. When the earphone 400 is placed inside the user's cavum conchae, the earpiece 430 can be squeezed and deformed by the user's ear canal, thus the housing 410 can abut the user's cavum conchae. Meanwhile, the earpiece 430 can be deformed to be closely attached to the ear canal, such that no sound is essentially leaked to the outside and an audio collection effect is improved. It should be understood that, in other embodiments, the earpiece 430 can be made of using non-deformable plastic material.

The resilient element 440 is shaped as a part of a capsule. The resilient element 440 is positioned at an end of the housing 410 away from the earpiece 430. The resilient element 440 can be deformed, such as expanding or contracting, when subjected to external force. In the illustrated embodiment, the material of the resilient element 440 is silica gel. In other embodiments, is made of silica gel. In other embodiments, the resilient element 440 can be made of collapsible plastic, or other flexible, elastically stretchable materials. In the illustrated embodiment, the resilient element 440 is made of transparent material. In other embodiments, the resilient element 440 can also be made of opaque materials.

Referring to FIG. 10, in the illustrated embodiment, the resilient element 440 is sleeved on the sound amplification portion 4124 of the second housing 412. The resilient element 440 has a greater length than that of the sound amplification portion 4124, thus allowing the resilient element 440 to be elastically deformed in a certain range. In addition, a space 441 similar to a resonant cavity can be formed between an inner wall of the resilient element 440 and a surface of the sound amplification portion 4124. A first sound output hole 4126 is provided at an end of the sound amplification portion 4124, and a second sound output hole 442 is provided on a side of the resilient element 440. A screw thread 4128 is provided on the sound amplification portion 4124, and a continuous spiral groove 4125 is formed between the resilient element 440 and the screw thread 4128. The first sound output hole 4126 is in communication with an initial portion of the spiral groove 4125, and the second sound output hole 442 is in communication with a terminal portion of the spiral groove 4125. In other words, the first sound output hole 4126 is in communication with the second sound output hole 442 via the spiral groove 4125. Therefore, sound generated by the drive unit 420 can enter the space 441 via the first sound output hole 4126, then rotate around the sound amplification portion 4124 for several times along the spiral groove 4125, and is directed out from the second sound output hole 442, which can cause the effect of low frequency enhancement, and the sound will not be trapped in the housing 410, thus rendering a better auditory experience. It should be understood that, the screw thread 4128 on the sound amplification portion 4124 can be omitted, as long as the sound can be transmitted directly to the second sound output hole 442 from the first sound output hole 4126.

One end of the earphone cord 450 is connected to the drive unit 420, and the other end of the earphone cord 450 extends out of the housing 410. A first through hole 413 is defined on a middle portion of a side of the second housing 412, and a second through hole 444 is defined on the resilient element 440 corresponding to the first through hole 413. The earphone cord 450 connected to the drive unit 420 extends through the first through hole 413 and the second through hole 444 subsequently in a direction substantially perpendicular to a central axis of the housing 410 and is connected to electronic devices, such as mobile phone, etc. In contrast with the conventional earphone in which the first through hole is defined at the rear end of the housing, the first through hole 413 according to the illustrated embodiment is positioned on the middle portion of a side of the sound amplification portion 4124, such that when the entire housing 410 is received in the user's cavum conchae, and the earphone cord 450 can extends between the user's tragus and antitragus.

Figure 12:
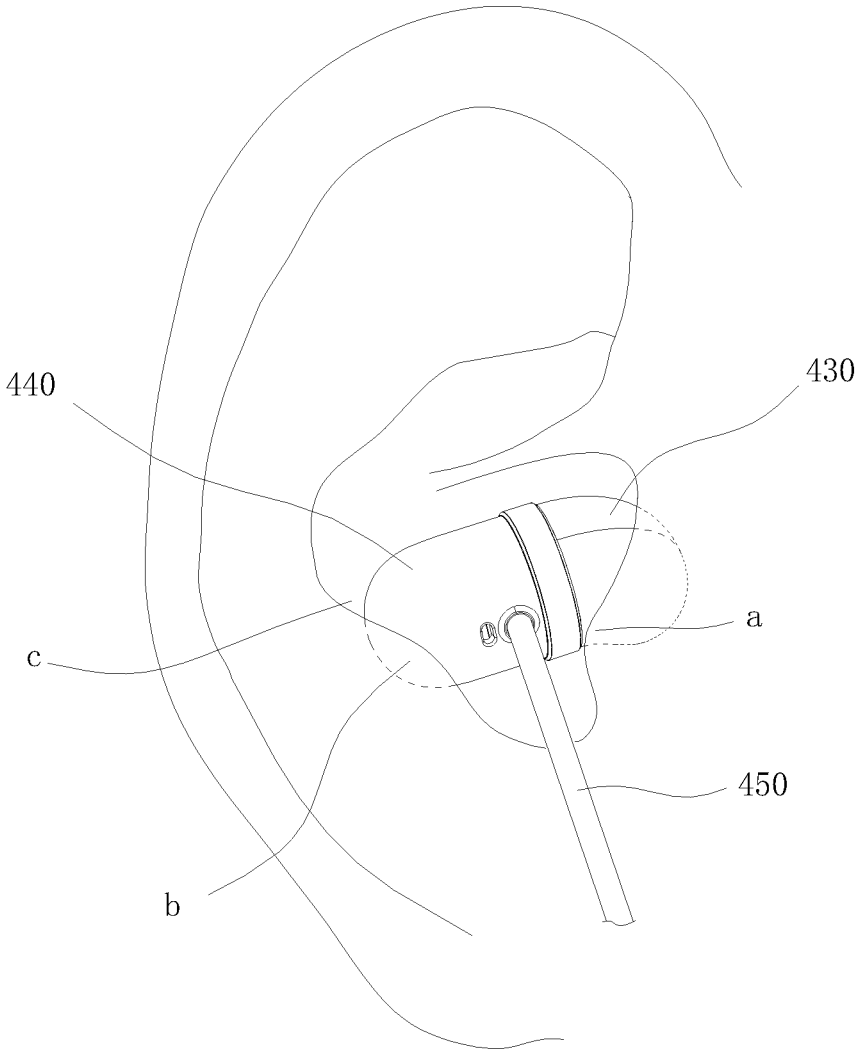
FIG. 12 is a perspective view of the earphone of FIG. 8 in a fitting state.
Figure 13:
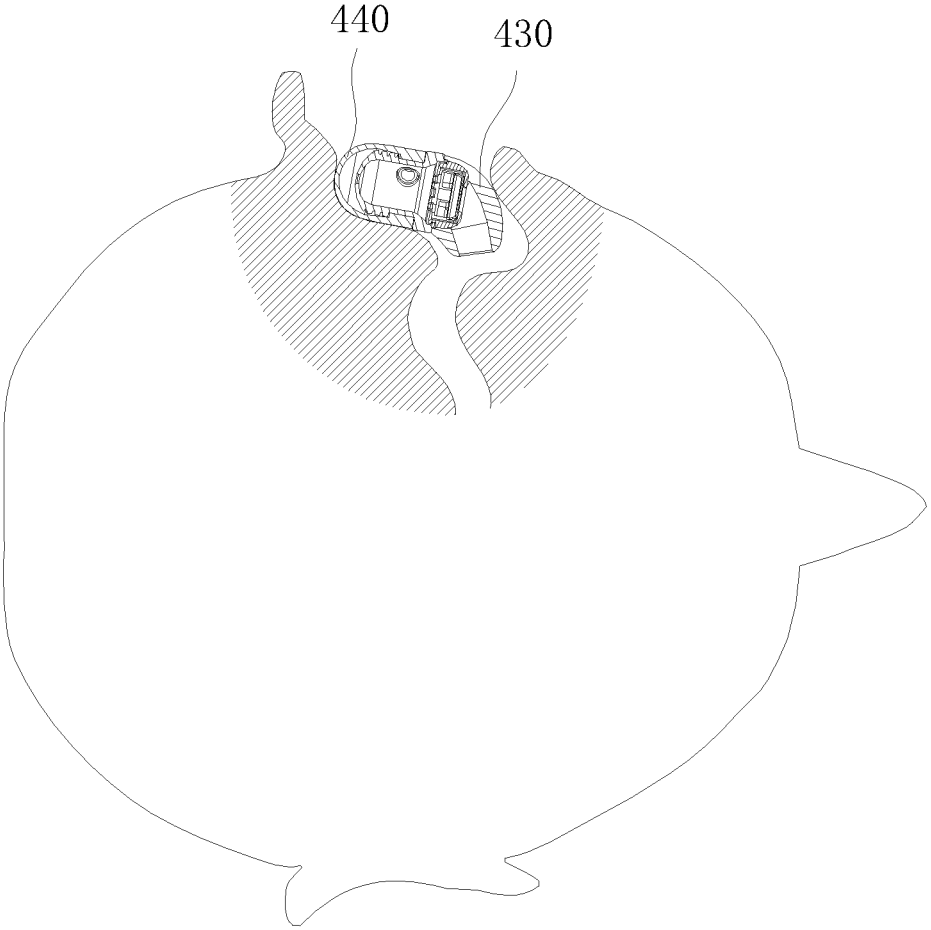
FIG. 13 is a cross-section view of the earphone of FIG. 8 in the fitting state.

Referring to FIG. 12 and FIG. 13, when wearing an earphone 400, the earpiece 430 and the resilient element 440 can be just accommodated inside the user's cavum conchae, and the resilient element 440 abuts the cavum conchae. By providing the resilient element 440 that can be squeezed and deformed with respect to the housing 410, the earphone will reduce the pressure felt by the user's ear, and it can be fit in the cavum conchae to ensure that the earphone 400 will not be easy to slip out from the user's ear, such that the earphone 400 can fit cavum conchae with different sizes. The space 441 provided between the resilient element 440 and the second housing 412 can further increase the stretching space of the resilient element 440 and wearing comfort. In addition, when the entire housing 410 and the earpiece 430 are accommodated inside the user's cavum conchae, the earphone cord 450 can extend between the user's tragus a and antitragus b, such that the outer surface of the earphone 400 can completely fit human's ear structure without causing any discomfort during wearing. When the earphone cord 450 is pulled downwardly, the tragus and the antitragus can hold the earphone 400 and prevent it from falling out of the cavum conchae, thus further increasing wearing stability and using convenience. It should be understood that, the earphone cord 450 can also be omitted as long as the earphone 400 is communicated with the electronic devices via Bluetooth.

Figure 14:
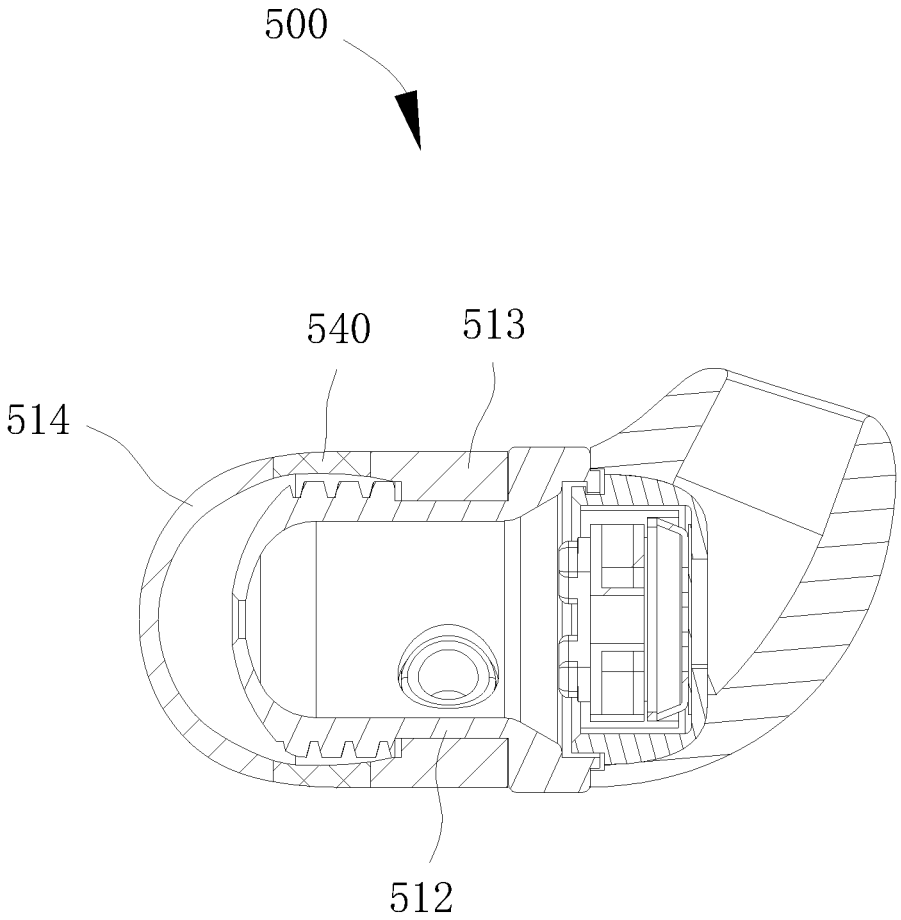
FIG. 14 is a cross-section view of an earphone in accordance with a sixth embodiment.

Referring to FIG. 14, an earphone 500 according to the sixth embodiment has a similar structure to the earphone 400 according to the fifth embodiment. The difference is that, the earphone 500 includes a third housing 513 and a fourth housing 514 sleeved on the second housing 512. The resilient element 540 is located between the third housing 513 and the fourth housing 514. When wearing the earphone 500, the third housing 513 or the fourth housing 514 can be squeezed, the resilient element 540 is then deformed, resulting in a relative displacement between the third housing 513 and the fourth housing 514, such that an end of the fourth housing 514 abuts the user's cavum conchae.

It should be understood that, in other embodiments, as similar to the fourth embodiment, a first partition plate is provided inside the third housing 513, and a second partition plate is provided the fourth housing 514. The resilient element 540 is a spring. One end of the resilient element 540 is fixed to the first partition plate, and the other end of the resilient element 540 is fixed to the second partition plate. When the third housing 513 or the fourth housing 514 is squeezed, the spring will be compressed, while it stretches into a natural state when it is not squeezed.

Although the respective embodiments have been described one by one, it shall be appreciated that the respective embodiments will not be isolated. Those skilled in the art can apparently appreciate upon reading the disclosure of this application that the respective technical features involved in the respective embodiments can be combined arbitrarily between the respective embodiments as long as they have no collision with each other.

Although the description is illustrated and described herein with reference to certain embodiments, the description is not intended to be limited to the details shown. Modifications may be made in the details within the scope and range equivalents of the claims.

What is claimed is:

1. An earphone defining a first end configured to be inserted into an ear canal of a user and a second end opposite to the first end configured to abut a cavum conchae of the user, the earphone comprising:

a housing having a sound output hole formed at the first end of the earphone;

a drive unit received inside the housing; and a resilient element disposed between the first end and the second end;

wherein the housing comprises a sound amplification portion, the resilient element is sleeved on the sound amplification portion with a space formed therebetween such that the resilient element is capable of being squeezed and deformed to thereby cause the first and second ends of the earphone to be squeezed toward each other, which allows the earphone to be suitable for cavum conchae with different sizes.

2. The earphone according to claim 1, wherein the resilient element shaped as a part of a capsule comprises an open end and a bottomed end, and the sound amplification portion is received in the resilient element through the open end with the space formed between the bottomed end of the resilient element and an end of the sound amplification portion away from the sound output hole.

3. The earphone according to claim 1, wherein the housing comprises a first housing and a second housing connected with the first housing, the sound output hole is provided at an end of the first housing away from the second housing, the sound amplification portion is formed at an end of the second housing away from the first housing, and a center axis line of the sound output hole is deviated from a center axis line of the drive unit.

4. The earphone according to claim 1, wherein the sound amplification portion defines a first sound output aperture, and the resilient element defines a second sound output aperture in communication with the first sound output aperture via a spiral groove formed between an outer surface of the sound amplification portion and an inner surface of the resilient element.

5. The earphone according to claim 1, wherein the housing defines a sound emission hole, the earphone further comprises an earpiece attached to the housing and configured to be inserted into the ear canal of the user, and the earpiece forms a hollow sound output channel in communication with and connected between the sound emission hole and the sound output hole such that sound generated by the drive unit can enter the sound output channel via the sound emission hole and then enter the ear canal of the user from the sound output channel via the sound output hole.

6. The earphone according to claim 5, wherein the sound output channel extends in an extension direction which is deviated from a center axis line of the housing by an angle $\alpha$, and the angle $\alpha$ satisfies: $50° \leq \alpha \leq 80°$.

7. The earphone according to claim 1, further comprising a cord, wherein the sound amplification portion defines a first through hole in a middle portion of a side of the sound amplification portion, the resilient element defines a second through hole corresponding to the first through hole, the cord extends through the first through hole and the second through hole to be connected to the drive unit, when the earphone is received in the cavum conchae of the user, the second end of the earphone abutting the cavum conchae of the user is squeezed toward the earpiece by the cavum conchae of the user, and the cord extends between a tragus and an antitragus of the user.

8. An earphone defining a first end configured to be inserted into an ear canal of a user and a second end opposite to the first end, the earphone comprising:

a housing having a sound output hole formed at the first end of the earphone;

a drive unit received inside the housing; and a resilient element disposed at the second end of the earphone and attached to the housing;

wherein a center axis line of the sound output hole is deviated from a center axis line of the housing by an angle; and wherein the resilient element is configured to abut a cavum conchae of the user and capable of being squeezed and deformed toward the first end of the earphone by the cavum conchae of the user to thereby cause the first and second ends of the earphone to be squeezed toward each other such that the earphone can fit cavum conchae with different sizes.

9. The earphone according to claim 8, wherein the housing comprises a sound amplification portion formed at an end thereof away from the sound output hole, and the resilient element is shaped as a part of a capsule and sleeved on the sound amplification portion with a space formed therebetween in the center axis line of the housing to thereby allow the resilient element to be axially deformed toward the sound amplification portion.

10. The earphone according to claim 9, wherein the sound amplification portion defines a first sound output aperture, and the resilient element defines a second sound output aperture in communication with the first sound output aperture.

11. The earphone according to claim 10, wherein the second sound output aperture is in communication with the first sound output aperture via a spiral groove formed between an outer surface of the sound amplification portion and an inner surface of the resilient element.

12. The earphone according to claim 10, wherein the first sound output aperture is defined in the center axis line of the housing and the second sound output aperture is offset from the center axis line of the housing.

13. The earphone according to claim 8, wherein the housing defines a sound emission hole, the earphone further comprises an earpiece attached to an end of the housing away from the resilient element and configured to be inserted into the ear canal of the user, and the earpiece forms a hollow sound output channel in communication with and connected between the sound emission hole and the sound output hole such that sound generated by the drive unit can enter the sound output channel via the sound emission hole and then enter the ear canal of the user from the sound output channel via the sound output hole.

14. The earphone according to claim 8, wherein the earphone further comprises a cord connected to the drive unit, when the earphone is received in the cavum conchae of the user, the first end and the second end of earphone are squeezed toward each other by the cavum concha of the user in a direction extending from an antitragus of the user toward a tragus of the user, and the cord extends between the tragus and the antitragus of the user.

15. An earphone defining a first end configured to be inserted into an ear canal of a user and a second end configured to abut a cavum conchae of the user, the earphone comprising:

a housing having a sound output hole formed at the first end of the earphone;

a drive unit received inside the housing; and a resilient element disposed between the first end and the second end;

wherein the resilient element is capable of being squeezed and deformed to thereby cause the first and second ends of the earphone to be squeezed toward each other such that the earphone can fit cavum conchae with different sizes.

16. The earphone according to claim 15, wherein when the earphone is received in the cavum conchae of the user, the second end of the earphone abutting the cavum conchae of the user is urged toward the first end by the cavum conchae of the user in a direction extending from an antitragus of the user toward a tragus of the user.

17. The earphone according to claim 15, wherein the housing comprises a first housing and a second housing, and the resilient element arranged between the first housing and the second housing is expandable or compressable, when subjected to an external force, to cause a relative displacement between the first housing and the second housing.

18. The earphone according to claim 15, wherein a center axis line of the sound output hole is deviated from a center axis line of the drive unit received inside the housing.

19. The earphone according to claim 15, wherein the housing comprises a first housing and a second housing connected with the first housing, the drive unit is received in the first housing, the earphone further comprises a third housing and a fourth housing, the resilient element is arranged between the third housing and the fourth housing, and the combined third housing, resilient element and fourth housing is sleeved on the second housing with an axial space formed between the second housing and the fourth housing.

20. The earphone according to claim 15, wherein the earphone further comprises an ear piece attached to the housing and configured to be inserted into the ear canal of the user, the first housing defines a sound emission hole, and the earpiece forms a hollow sound output channel in communication with and connected between the sound emission hole and the sound output hole such that sound generated by the drive unit can enter the sound output channel via the sound emission hole and then enter the ear canal of the user from the sound output channel via the sound output hole, wherein the sound output channel extends in an extension direction which is deviated from a center axis line of the drive unit.

* * * * *